US009682804B2

(12) United States Patent
Hatton et al.

(10) Patent No.: US 9,682,804 B2
(45) Date of Patent: Jun. 20, 2017

(54) FLOW CONTROL DEVICE AND PROCESS

(71) Applicant: AptarGroup, Inc., Crystal Lake, IL (US)

(72) Inventors: Jason Hatton, Essexville, MI (US); Andrew Brunner, Lincolnton, NC (US); Andrew Smith, Essexville, MI (US)

(73) Assignee: AptarGroup, Inc., Crystal Lake, IL (US)

( * ) Notice: Subject to any disclaimer, the term of this patent is extended or adjusted under 35 U.S.C. 154(b) by 0 days.

(21) Appl. No.: 14/766,050

(22) PCT Filed: Apr. 8, 2015

(86) PCT No.: PCT/US2015/024861
§ 371 (c)(1),
(2) Date: Jul. 29, 2016

(87) PCT Pub. No.: WO2016/164007
PCT Pub. Date: Oct. 13, 2016

(65) Prior Publication Data

US 2016/0347516 A1 Dec. 1, 2016

(51) Int. Cl.
*B65D 35/50* (2006.01)
*B65D 35/52* (2006.01)
(Continued)

(52) U.S. Cl.
CPC ..... *B65D 47/2031* (2013.01); *B65D 47/2025* (2013.01); *B65D 47/2037* (2013.01); *B65D 47/44* (2013.01)

(58) Field of Classification Search
CPC ..... B65D 47/2031; B65D 47/2037; B65D 47/2025; B65D 47/44
See application file for complete search history.

(56) References Cited

U.S. PATENT DOCUMENTS 5,271,531 A * 12/1993 Rohr ..... B65D 47/0833 215/232
5,409,144 A * 4/1995 Brown ..... B65D 47/2031 220/203.17
(Continued)

FOREIGN PATENT DOCUMENTS

EP 1849489 B1 10/2009

OTHER PUBLICATIONS

The "International Search Report and Written Opinion of the International Searching Authority, or the Declaration" dated "Jul. 10, 2015" for the International Application No. PCT/US2015/024861 of which the above-captioned instant U.S. patent application is a U.S. National Phase application.

*Primary Examiner* — Frederick C Nicolas
(74) *Attorney, Agent, or Firm* — Wood, Phillips, Katz, Clark & Mortimer

(57) ABSTRACT

A flow control device (20) and process are provided for controlling the flow of a pressurized fluid substance from a supply system (22). The device (20) includes a housing (30/40) that defines an orifice (84) for communicating between the supply system (22) that has an outlet end defining a discharge opening (57). The device 20 further includes a valve (140) having a flexible, resilient valve head (160) that has confronting, openable portions (186) movable from a closed configuration to an open configuration when the valve head (160) is subjected to a pressure differential acting across the valve head (160). The valve (140) is located across the housing outlet end discharge opening (57) so that the valve (140) and the housing (30/40) together define an expansion chamber (198) between the orifice (84) and the valve (140).

1 Claim, 15 Drawing Sheets

(51) Int. Cl.

| | |
|---|---|
| ***B65D 47/20*** | (2006.01) |
| ***B65D 47/22*** | (2006.01) |
| ***F16K 21/04*** | (2006.01) |
| *B65D 47/44* | (2006.01) |

(56) References Cited

U.S. PATENT DOCUMENTS

| | | | | |
|---|---|---|---|---|
| 5,531,363 | A | 7/1996 | Gross et al. | |
| 6,062,436 | A * | 5/2000 | Fuchs | B65D 47/2031 137/846 |
| 6,112,952 | A | 9/2000 | Hess, III et al. | |
| 6,269,986 | B1 | 8/2001 | Gross | |
| 6,273,296 | B1 | 8/2001 | Brown | |
| 6,749,092 | B2 | 6/2004 | Olechowski et al. | |
| 7,784,652 | B2 | 8/2010 | Gaus et al. | |
| 8,397,958 | B2 * | 3/2013 | Smith | B65D 47/2031 222/105 |
| 8,973,789 | B2 * | 3/2015 | Smith | B65D 47/2031 222/105 |
| 2002/0130139 | A1 * | 9/2002 | Shiraishi | B65D 23/02 222/105 |
| 2003/0029890 | A1 * | 2/2003 | Olechowski | B65D 47/10 222/525 |
| 2006/0138163 | A1 * | 6/2006 | Danks | B65D 51/1611 222/1 |
| 2007/0284397 | A1 | 12/2007 | Hickok et al. | |
| 2008/0237278 | A1 | 10/2008 | Gaus et al. | |
| 2010/0193516 | A1 | 8/2010 | Labean et al. | |
| 2014/0224356 | A1 | 8/2014 | Hatton et al. | |

* cited by examiner

FLOW CONTROL DEVICE AND PROCESS

CROSS-REFERENCE TO RELATED APPLICATIONS

Not Applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a flow control device for a fluid substance supply system containing a pressurized fluid such as a liquid and/or gas.

BACKGROUND OF THE INVENTION AND TECHNICAL PROBLEMS POSED BY THE PRIOR ART

In some situations, it may be desirable to dispense a pressurized fluid substance (i.e., a product) in a convenient manner from a supply of the substance to a receiver or other target region. For example, it may be desirable to dispense a beverage product, consisting of two or more constituent fluid components and/or phases, through a discharge outlet to a cup, glass, or other serving container.

The inventors of the present invention have discovered that some types of fluid substances are difficult to discharge from a supply system as a flow stream having the desired discharge characteristics (e.g.; flow stream uniformity or consistency, flow stream cross-sectional configuration, volumetric flow rate, etc.) For example, the inventors of the present invention have observed that the dispensing of some pressurized fluid products may result in an undesirable spray and/or an undesirably low flow rate. Also, at the conclusion of the product discharge, some small amount of the residual fluid product may subsequently fall as a drop or droplet from the supply system outlet.

The inventors of the present invention have discovered that, at least in some applications, one or more of the above-described conditions may result in a "messy" discharge, and/or may result in the discharged product having an aesthetically undesirable appearance, and/or may result in the product being dispensed with undesirable characteristics, and/or may result in an inadequate discharge quantity of the product.

The inventors of the present invention have determined that for at least some applications in which some types of fluid products are dispensed using some types of dispensers (or other product supply systems), it may be desirable to provide a flow control device and process that can eliminate, or at least reduce or minimize, the above-described undesirable discharge conditions or characteristics.

The inventors of the present invention have further determined that it would be beneficial to provide an improved flow control device for a pressurized fluid substance dispensing system containing a fluid substance (i.e., a product) that can be readily dispensed to a receiver (e.g., cup) or other target region. Such a flow control device could be advantageously employed in a variety of applications, including, but not limited to, applications for dispensing consumer products, for example, beverage products.

The inventors of the present invention have also discovered that it would be desirable to provide, at least for one or more types of applications, an improved flow control device that can be configured with the dispensing system so as to have one or more of the following advantages:

A. ease of manufacture and/or assembly, and

B. relatively low cost manufacture and/or assembly.

BRIEF SUMMARY OF THE INVENTION

The inventors of the present invention have discovered how to provide an improved flow control device and process for controlling flow of a pressurized, fluid substance from a supply system that has an opening between the exterior and interior of the system. The device can be used with a fluid substance dispensing system, and, in some applications involving the dispensing of a pressurized fluid substance, can accommodate a higher flow rate while eliminating or minimizing undesirable spray, and/or undesirable characteristics in the discharged product, and/or residual dripping after termination of the discharge flow.

According to one aspect of the invention, the flow control device comprises:

A. a housing that
  1) has an inlet end that can be located at the supply system opening;
  2) includes an orifice that is centered on a central longitudinal axis and that communicates between the exterior and interior of the supply system (22); and
  3) has an outlet end defining a discharge opening; and B. a valve having a flexible, resilient, circular valve head centered on the longitudinal axis and that has
  1) at least one self-sealing slit through the valve head; and
  2) confronting, openable portions along the at least one self-sealing slit in an initially closed configuration wherein the openable portions are movable from the initially closed configuration to an open configuration when the valve head is subjected to a pressure differential acting across the valve head; and wherein the valve is located across the housing outlet end discharge opening at a location spaced from the housing orifice so that (a) the longitudinal axis of the valve head is co-linear with the longitudinal axis defined by the orifice, and (b) the valve and the housing together define an expansion chamber between the orifice and the valve for receiving the fluent substance at a pressure reduced from the pressure within the supply system.

According to another aspect of the invention, the flow control device comprises:

A. a housing that
  (1) has an inlet end that can be located at the supply system opening;
  (2) defines an orifice for communicating between the supply system exterior and interior; and
  (3) has an outlet end defining a discharge opening; and B. a valve having a flexible, resilient valve head that has
  1) at least one self-sealing slit through the valve head; and
  2) confronting, openable portions along the at least one self-sealing slit in an initially closed configuration, the openable portions being movable from the closed configuration to an open configuration when the valve head is subjected to a pressure differential acting across the valve head;

wherein the valve is located across the housing outlet end discharge opening at a location spaced from the housing orifice so that the valve and the housing together define an expansion chamber between the orifice and the valve for receiving the fluid substance at a pressure reduced from the pressure within the supply system;

wherein the housing comprises 1) an annular frame for
   a) being attached to the supply system at the supply system opening; and
   b) receiving the valve supported thereon; and
2) an annular retainer ring that
   a) is received in the annular frame;
   b) defines the orifice; and
   c) retains the valve in the annular frame so that the expansion chamber is defined between said annular retainer ring and the valve; and wherein the annular frame includes 1) a first annular wall for engaging the retainer ring to hold the retainer ring against valve;
2) a seating surface extending radially inwardly from the first annular wall for engaging a portion of the valve;
3) a second annular wall around the first annular wall; and
4) a plurality of circumferentially spaced tabs extending from the second annular wall, each tab including a radially outwardly facing recess for receiving a portion of the supply system in snap-fit engagement to mount the flow control device to the supply system.

According to another aspect of the invention, a process is provided for controlling the flow of a pressurized fluid substance from a supply system that has an opening between the exterior and interior of the supply system. The process comprises the steps of:

A. providing a housing that
   1) has an inlet end that can be located at the supply system opening;
   2) defines an orifice for communicating between the exterior and interior of the supply system; and
   3) has an outlet end defining a discharge opening;
B. providing a valve having an upstream, interior side for facing the orifice and having a flexible, resilient valve head that has
   1) at least one self-sealing slit through the valve head; and
   2) confronting, openable portions along the at least one self-sealing slit in an initially closed configuration, the openable portions being movable from the closed configuration to an open configuration when the valve head is subjected to a pressure differential acting across the valve head;
C. locating the valve across the housing outlet end discharge opening at a location spaced from the housing orifice so that the valve and the housing together define an expansion chamber between the orifice and the valve for receiving the fluid substance at a pressure reduced from the pressure within the supply system;
D. supplying the fluid substance in the supply system at a gauge pressure between about 24 kPa and about 25 kPa;
E. admitting the fluid substance through the orifice into the expansion chamber at a gauge pressure between about 16 kPa and about 21 kPa on the upstream side of the valve; and
F. discharging the fluid substance through the valve in the open configuration.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

While the flow control device of this invention is susceptible of embodiment in many different forms, this specification and the accompanying drawings disclose only some specific forms as examples of the invention. The invention is not intended to be limited to the embodiments so described, however.

For ease of description, the device of this invention is described in a generally vertical orientation in cooperation with a fluid substance supply system. It will be understood, however, that this invention may be manufactured, stored, transported, used, and sold in orientations other than the orientation shown.

The device of this invention is suitable for use with a variety of conventional or special pressurized fluid substance supply systems having various designs, the details of which, although not illustrated or described, would be apparent to those having skill in the art and an understanding of such systems.

Figures illustrating the components of the inventive device in cooperation with a fluid substance supply system show some conventional mechanical or structural feature that are known to, and that will be recognized by, one skilled in the art. The detailed descriptions of such features are not necessary to an understanding of the invention, and accordingly, are herein presented only to the degree necessary to facilitate an understanding of the novel aspects of the present invention.

Figure 7:
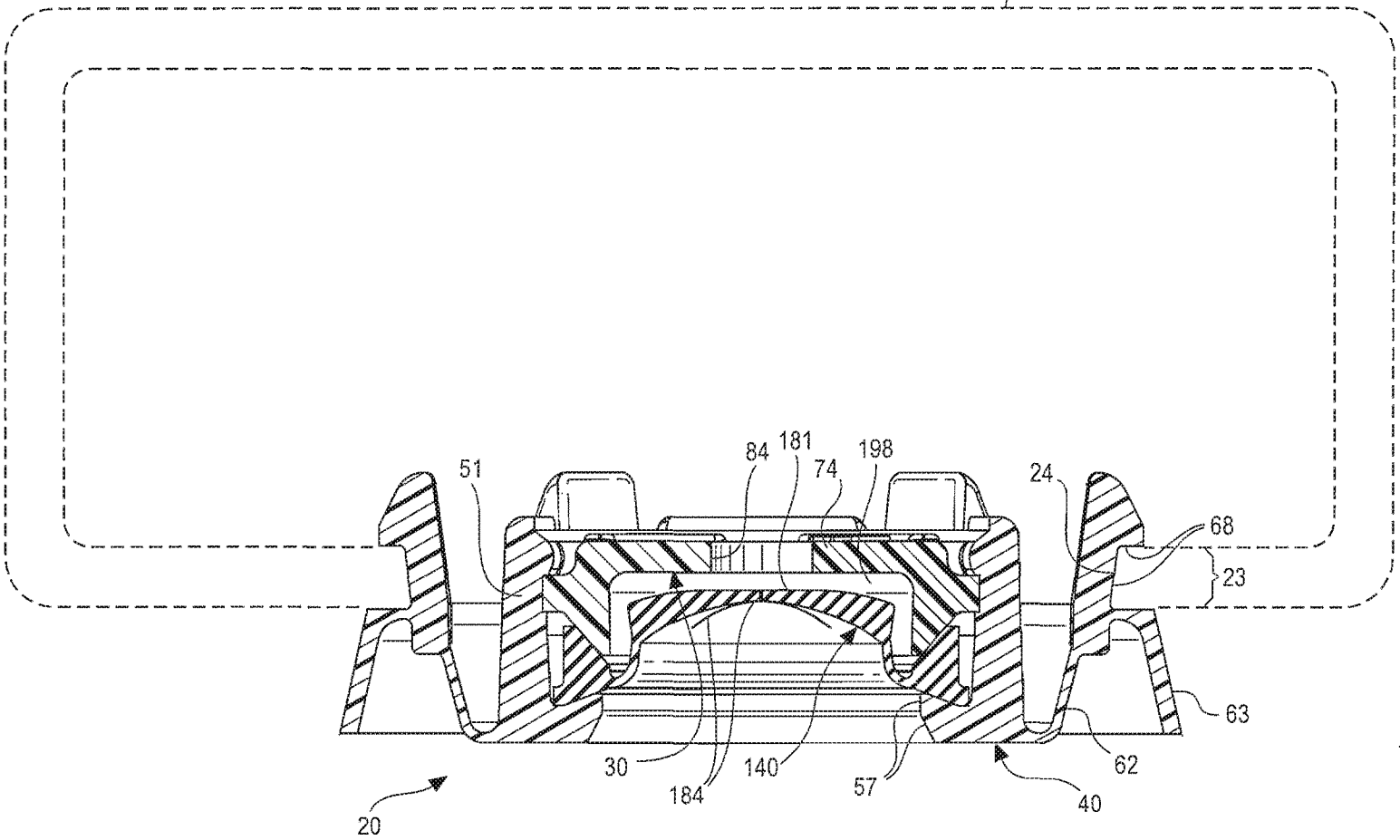
FIG. 7 is a view similar to FIG. 5, but FIG. 7 shows the device attached to a fluid substance supply system that is schematically illustrated in dashed lines.

As shown in FIG. 7, the flow control device 20 is used for controlling the flow of a pressurized fluid substance from a supply system 22 which is schematically illustrated with dashed lines in FIG. 7. The flow control device 20 is adapted to be in communication with the interior of the supply system 22, and in the embodiment illustrated in FIG. 7, the flow control device 20 is adapted to be installed or mounted in or on the supply system 22 or otherwise associated with the supply system 22 in a manner that permits the communication between the flow control device 20 and the interior of the supply system 22. In another embodiment (not illustrated), some portion or portions of the flow control device 20 could be formed as an integral structure that is a unitary part of the supply system 22.

In the embodiment of the flow control device 20 illustrated in FIG. 7, the flow control device 20 is adapted to be mounted on, and attached to, a wall portion 23 of the supply system 22 wherein the wall portion 23 of the supply system 22 is schematically shown in FIG. 7 as having a predetermined thickness.

The supply system 22 has an opening 24 (FIG. 7) is in communication with the flow control device 20. The wall portion 23 of the supply system 22 may be characterized as defining an opening 24 between the exterior of the supply system 22 and the interior of the supply system 22. The supply system 22 may be, for example, a container, tank, reservoir, fluid processing system, or fluid delivery system which contains a pressurized fluid substance (including a system which generates or otherwise creates a pressurized fluid substance therein).

Figure 1:
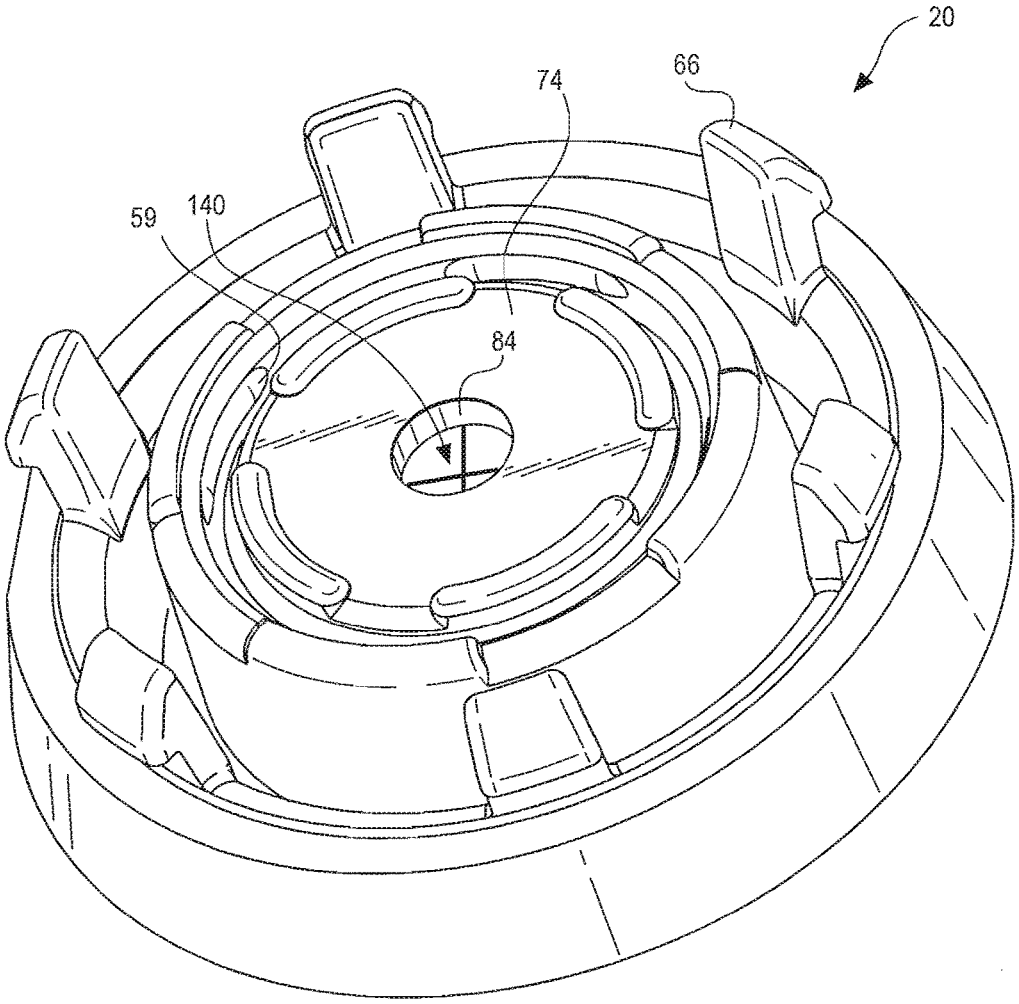
FIG. 1 is an isometric view of a flow-control device of the present invention for controlling the flow of a pressurized fluid substance from a supply system (not shown in FIG. 1) and wherein the flow control device is viewed looking toward the interior side of the device that would be attached to, or would otherwise be in communication with, an opening in the supply system.
Figure 2:
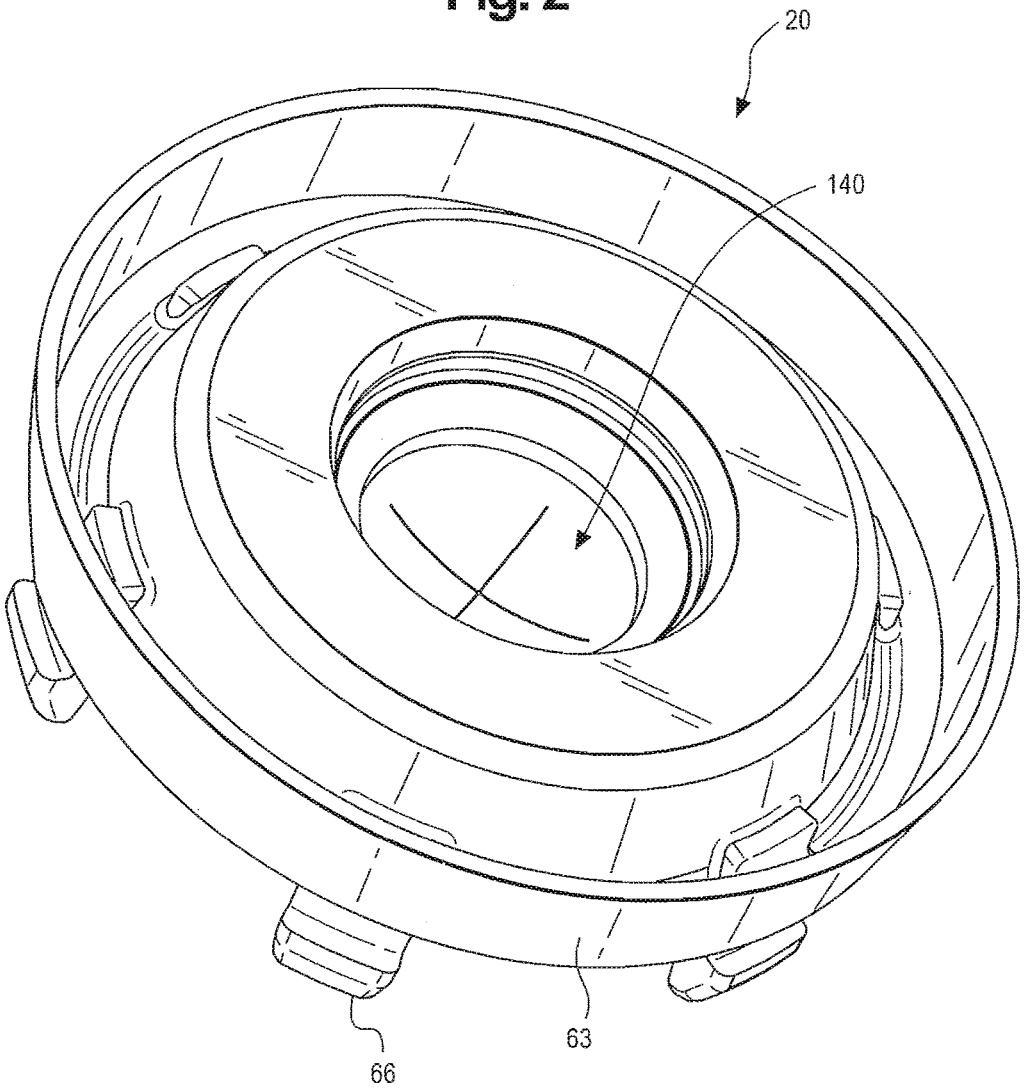
FIG. 2 is an isomeric view of the flow-control device shown in FIG. 1, but in FIG. 2 the device is viewed looking toward the opposite, exterior side of the device from which the fluid substance is dispensed or otherwise discharged.
Figure 3:
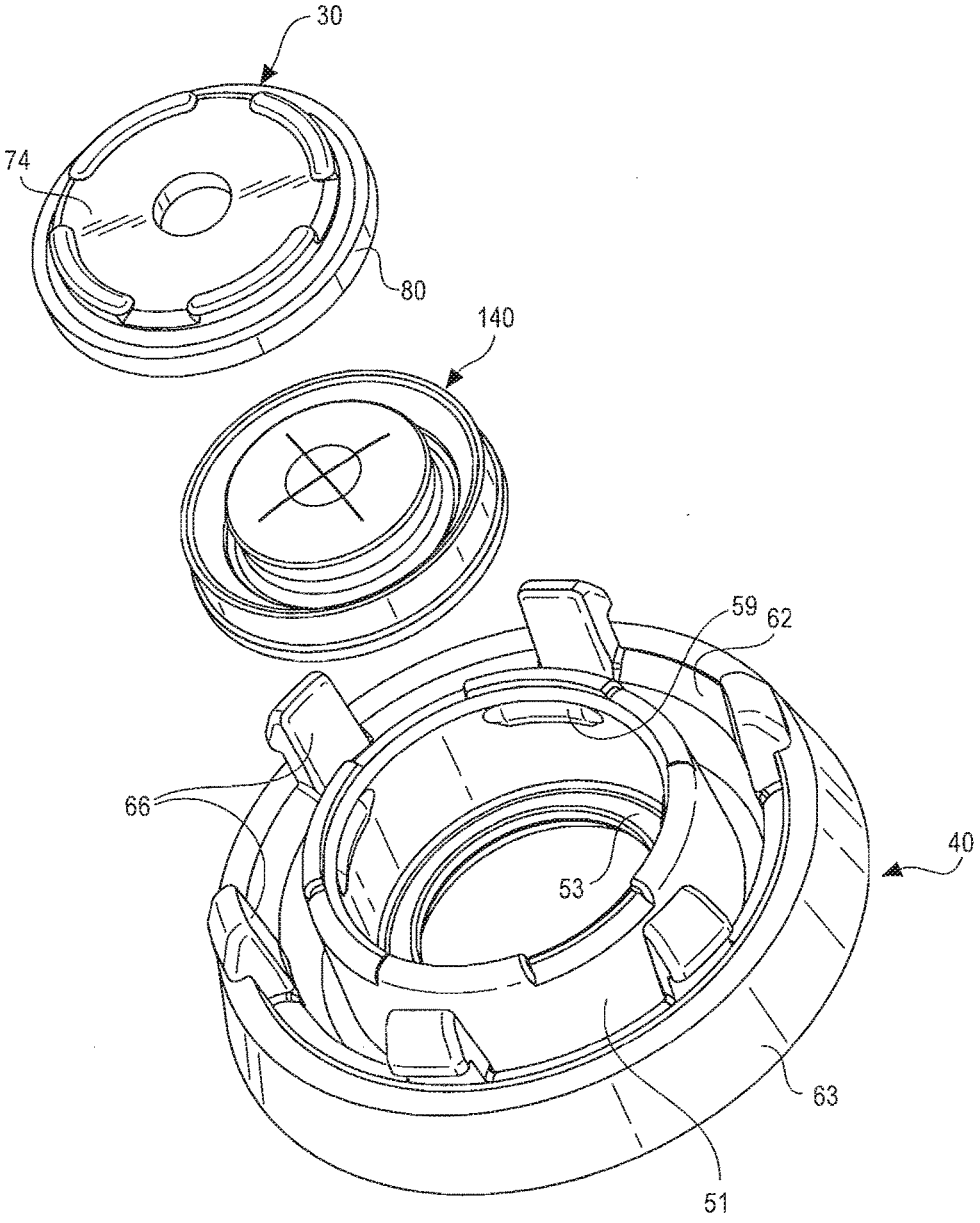
FIG. 3 is an exploded, isometric view of the flow-control device illustrated in FIG. 1.
Figure 4:
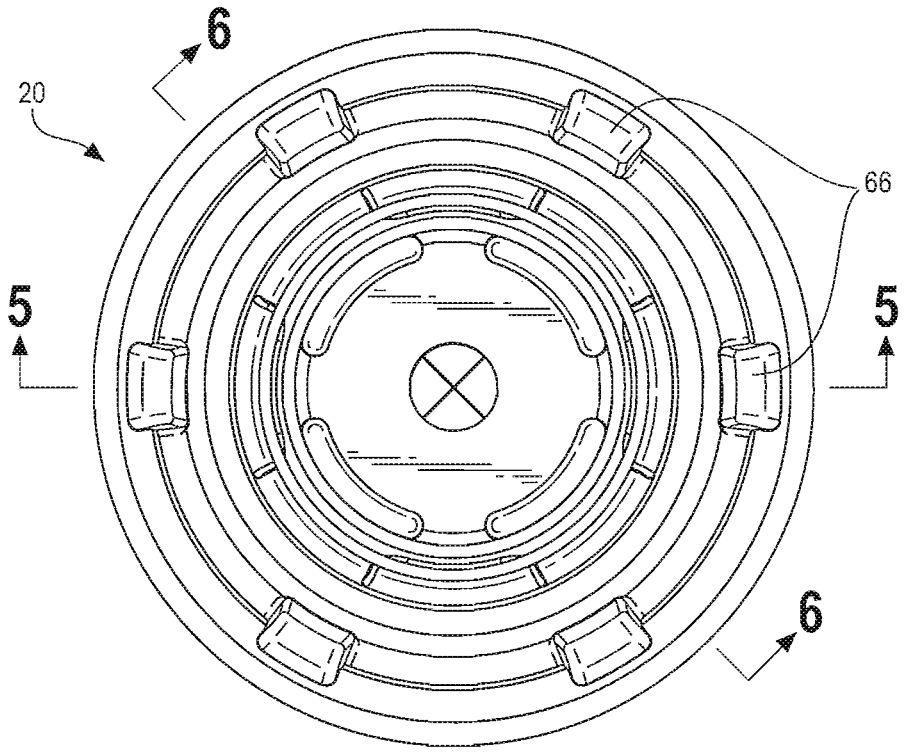
FIG. 4 is a plan view of the flow control device showing the interior side of the device which would be attached to, or would otherwise be in communication with, the fluid substance supply system.
Figure 5:
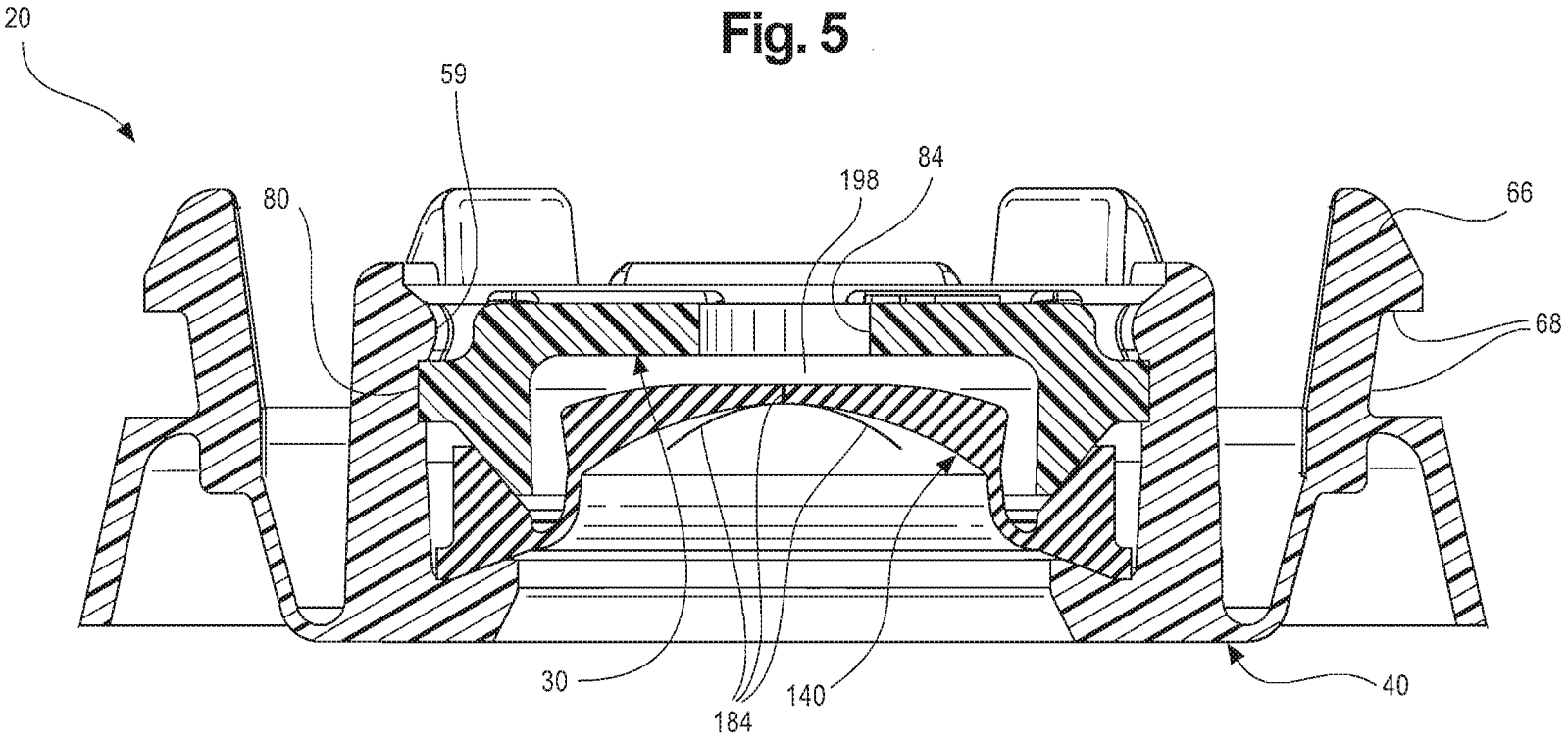
FIG. 5 is a cross-sectional view taken generally along the plane 5-5 in FIG. 4.
Figure 6:
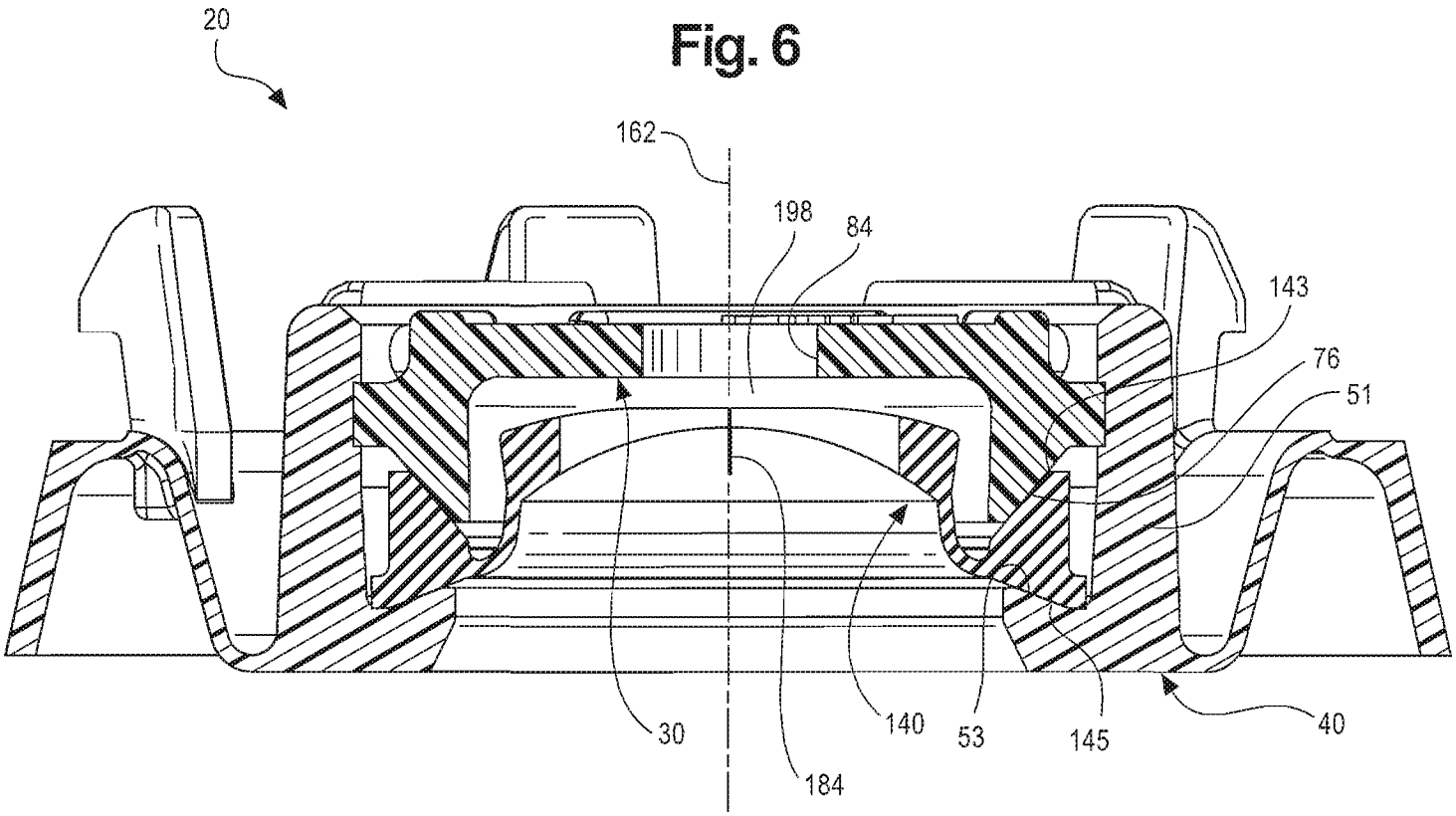
FIG. 6 is a cross-sectional view taken generally along the plane 6-6 in FIG. 4.

With reference to FIGS. 3, 5 and 6, one presently preferred embodiment of the flow control device 20 includes three components: an inner collar or retainer ring 30, an outer collar or annular frame 40, and a valve 140.

The inner housing or retainer ring 30 and the outer housing or annular frame 40 are adapted to be snap-fit together to clamp the valve 140 between them as shown in FIGS. 5 and 6. Together, the inner collar 30 and outer collar 40 may be characterized as defining a "housing" 30/40 that can be located at the opening 24 of the supply system 22 as illustrated in FIG. 7. More particularly, the outer collar 40 may be characterized as being an annular frame 40 for receiving the valve 140 supported thereon and for being attached to the supply system 22 at the supply system opening 24. Further, and more particularly, the inner collar 30 may be characterized as an annular retainer ring 30 that is received in the annular frame 40 and that retains the valve 140 in the annular frame 40.

Figure 13:
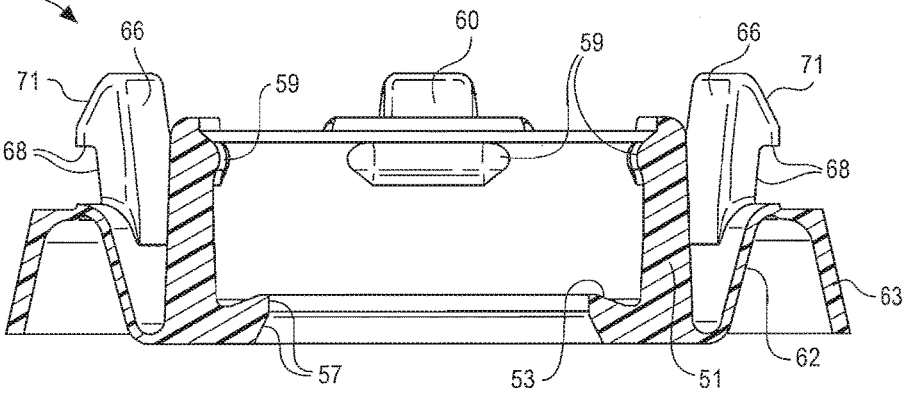
FIG. 13 is a cross-sectional view taken generally along the plane 13-13 in FIG. 12.
Figure 14:
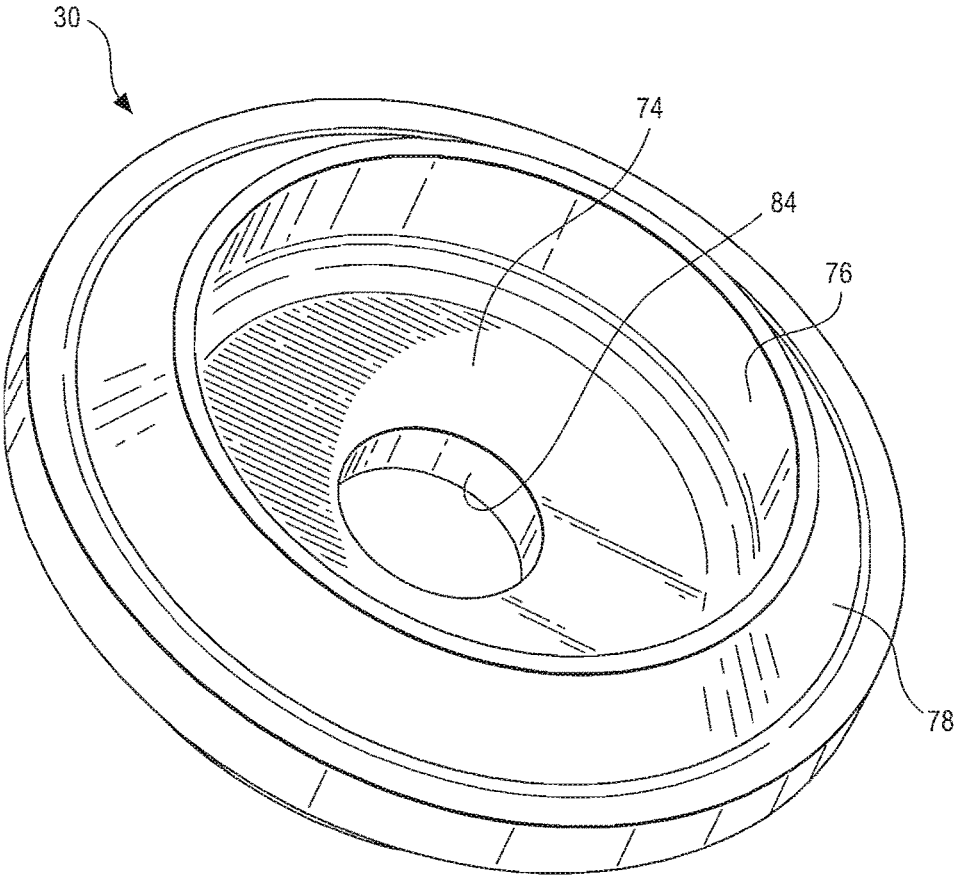
FIG. 14 is an isometric view of the inner collar, and in FIG. 14 the inner collar is viewed looking toward the bottom, or outwardly facing side, of the inner collar.
Figure 15:
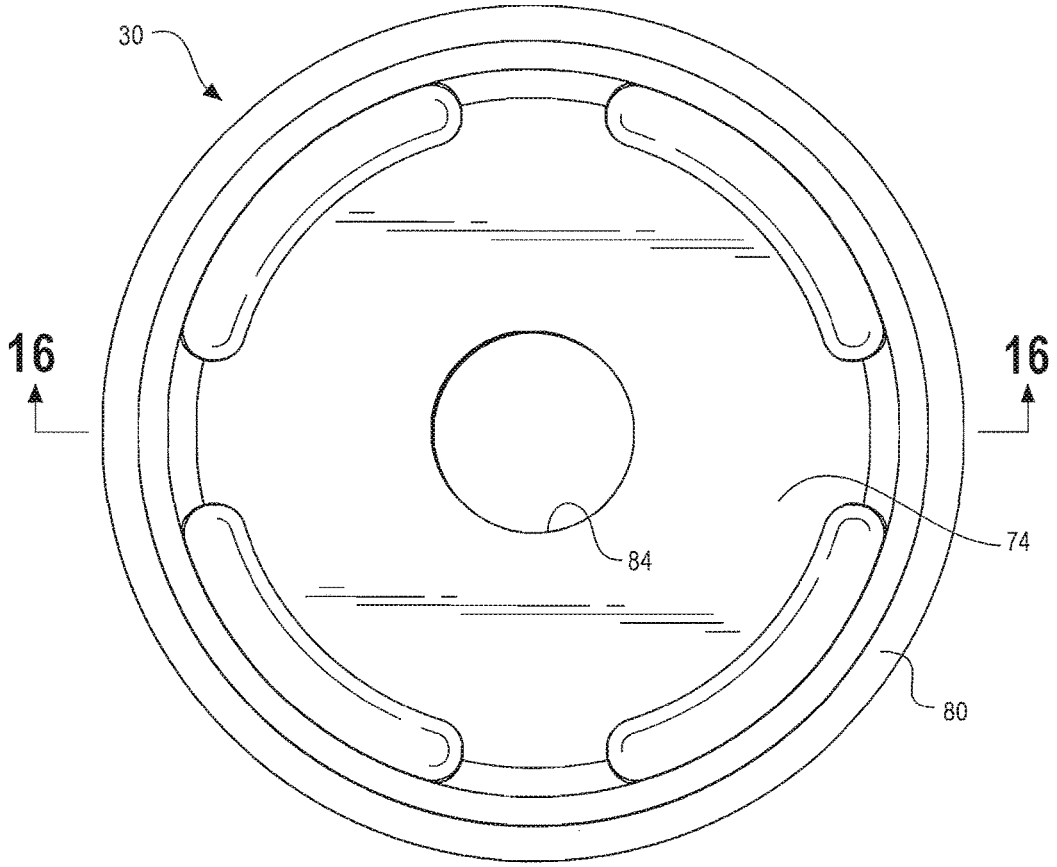
FIG. 15 is a plan view of the inwardly facing side of the inner collar which faces, and is adapted to be in communication with, the fluid substance supply system.

With reference to FIG. 13, the annular frame or outer collar 40 includes an inner annular wall or first annular wall 51. A frustoconical seating surface 53 extends radially inwardly from the first annular wall 51 for engaging a portion of the valve 140 (FIG. 6). As can be seen in FIG. 13, the inner periphery of the annular frame or outer collar 40 at the radially innermost extent of the frustoconical seating surface 53 may be characterized as functioning as an outlet end defining a discharge opening 57.

Figure 12:
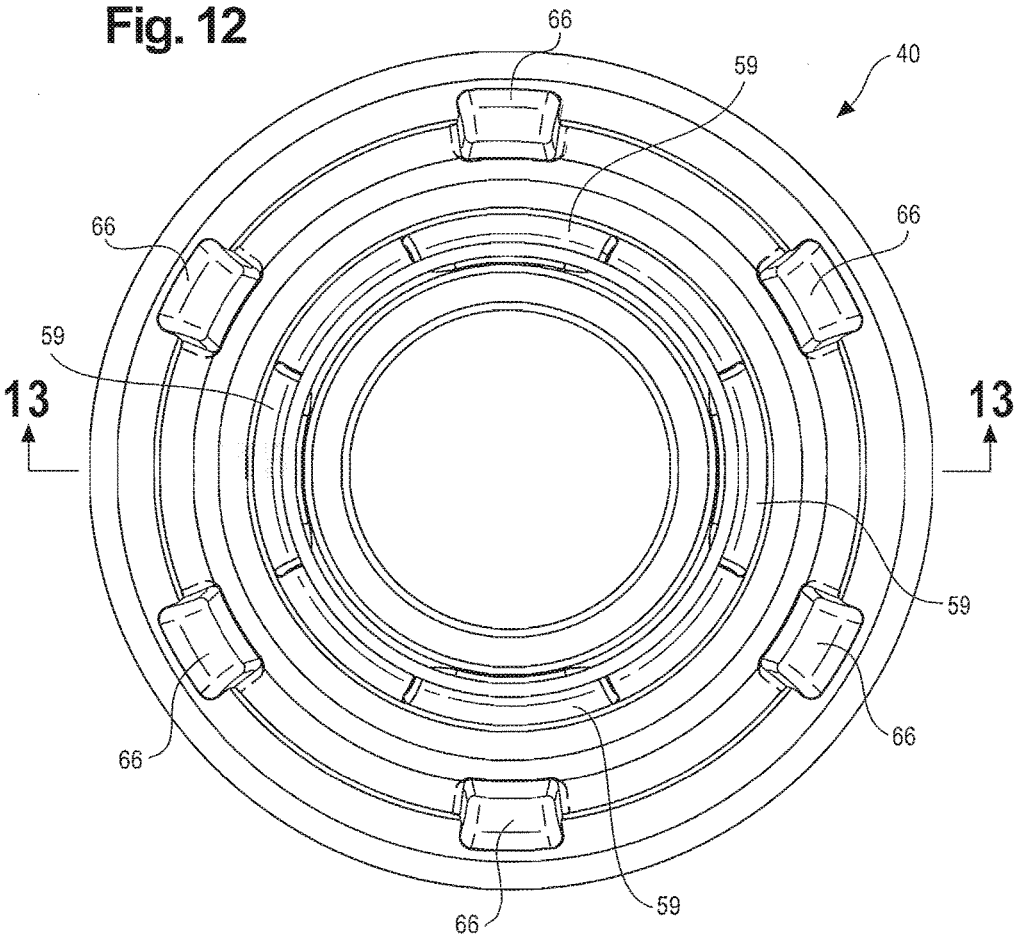
FIG. 12 is a plan view of the interior side of the outer collar shown in FIG. 11.

As can be seen in FIGS. 12 and 13, the upper end portion of the first annular wall 51 defines a plurality of circumferentially spaced-apart beads 59 that extend radially inwardly from the first annular wall 51 and that are spaced axially inwardly of the seating surface 53 for engaging the inner collar 30 as described in detail hereinafter.

The annular frame or outer collar 40 includes a second annular wall 62 around the first annular wall 51 as can be seen in FIG. 13. The second annular wall 62 is connected at its lower end to the bottom of the first annular wall 51, and the second annular wall 62 extends upwardly and radially outwardly therefrom. The annular frame or outer collar 40 also includes a third annular wall 63 that extends downwardly and radially outwardly from the top of the second annular wall 62.

As can be seen in FIG. 13, at the top of the annular frame second annular wall 62, there are a plurality of circumferentially spaced tabs 66 which each extend axially inwardly (upwardly with reference to FIG. 13). Each tab 66 defines a radially outwardly facing recess 68 for receiving the wall portion 23 of the supply system 22 as can be seen in FIG. 7. In the preferred embodiment illustrated in FIG. 13, each tab 66 also includes a chamfered distal end or surface 71 to accommodate initial sliding engagement with, and movement relative to, the wall portion 23 of the supply system 22 so as to enable the annular frame 40 (carrying the valve 140 and the inner collar 30) to be readily inserted into the opening 24 of the supply system wall portion 23 for snap-fit engagement with the supply system wall portion 23.

With reference to FIGS. 3, 14, 15, and 16, the inner collar or retainer ring 30 includes an inner plate portion 74 defining an upstream side, and includes an annular wall 76 depending from the plate portion 74. The axially outwardly end of the wall 76 defines a frustoconical clamping surface 78 for engaging a peripheral portion of the valve 140 to clamp the valve 140 between the inner collar or retaining ring 30 and the outer collar or annular frame 40.

The annular wall 76 of the inner collar 30 also includes a radially outwardly projecting flange 80 for being engaged in a snap-fit relationship below the beads 59 of the outer collar 40 (as shown in FIG. 5) to hold the inner collar 30 in clamping relationship against the peripheral portion of the valve 140.

Figure 16:
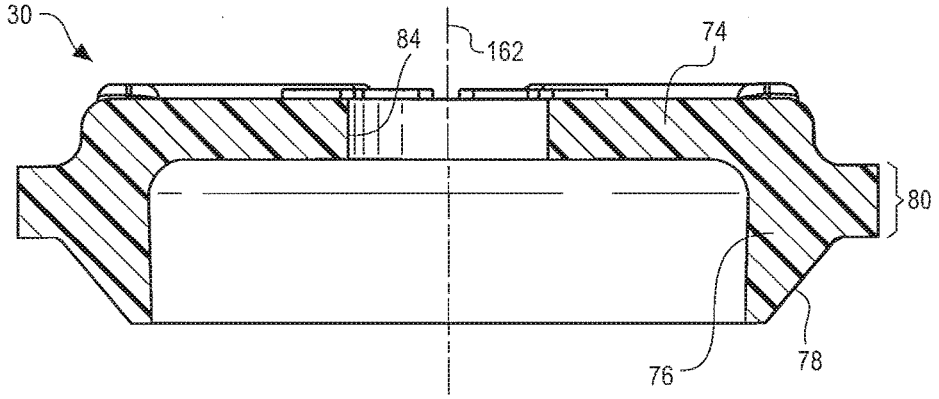
FIG. 16 is a cross-sectional view taken generally along the plane 16-16 in FIG. 15.

With reference to FIGS. 7 and 14-16, the plate portion 74 of the inner collar 30 defines an orifice 84 that is centered on a longitudinal axis 162 (FIGS. 7 and 16). When the inner collar 30 is mounted in the outer collar 40 to hold the valve 140 in place on the outer collar or annular frame 40, the assembly of the inner collar 30 and the outer collar 40 may be characterized as a "housing" 30/40 in which the orifice 84 of the retainer ring (inner collar) 30 functions as an orifice 84 for communicating between the exterior and interior of the supply system 22 (when the flow control device 20 is mounted on the supply system 22 as shown in FIG. 7).

In the embodiment of the device illustrated, the valve 140 is a flexible, resilient, pressure-openable, self-closing, slit-type valve. Forms of such a type of valve are disclosed in the U.S. Pat. Nos. 8,678,249 and 5,839,614. The descriptions of those patents are incorporated herein by reference thereto to the extent pertinent and to the extent not inconsistent herewith.

The valve 140 is suitable for use with flowable substances, such as liquids and gases, including, inter alia, beverages, lotions, and creams. The valve 140 is preferably molded as a unitary structure (i.e., one-piece structure) from material which is flexible, pliable, elastic, and resilient. This can include elastomers, such as a synthetic, thermosetting polymer, including silicone rubber, such as the silicone rubber sold by Dow Corning Corporation in the United States if America under the trade designation D.C. 99-595 and RBL-9595-40. Another suitable silicone rubber material is sold in the United States of America under the designation Wacker 3003-40 by Wacker Silicone Company. The valve 140 could also be molded from other thermosetting materials or from other elastomeric materials, or from thermoplastic polymers or thermoplastic elastomers, including those based upon materials such as thermoplastic propylene, ethylene, urethane, and styrene, including their halogenated counterparts. For example, a particular non-silicone material that may be employed is ethylene propylene diene monomer rubber ("EPDM"), such as sold in the United States of America under the designation Grade Z1118 by Gold Key Processing, Inc. having an office at 14910 Madison Road, Middlefield, Ohio 44062, United States of America. Another non-silicone material that may be employed is nitrile rubber, such as sold in the United States of America under the designation Grade GK0445081-2 by Graphic Arts Rubber, having an office at 101 Ascot Parkway, Cuyahoga Falls, Ohio 44223, United States of America. It is desirable in many applications that the material be substantially inert so as to avoid reaction with, and/or adulteration of, the fluent substance in contact with the valve.

The valve 140 has an initially closed, unactuated, substantially unstressed, rest position or configuration (as best seen in FIGS. 3, 5, 6, 7, 8, 9, and 10). The valve 140 can be forced to an "open" position or configuration (FIG. 17) when a sufficiently high pressure differential acts across the valve 140 as described hereinafter.

Figure 10:
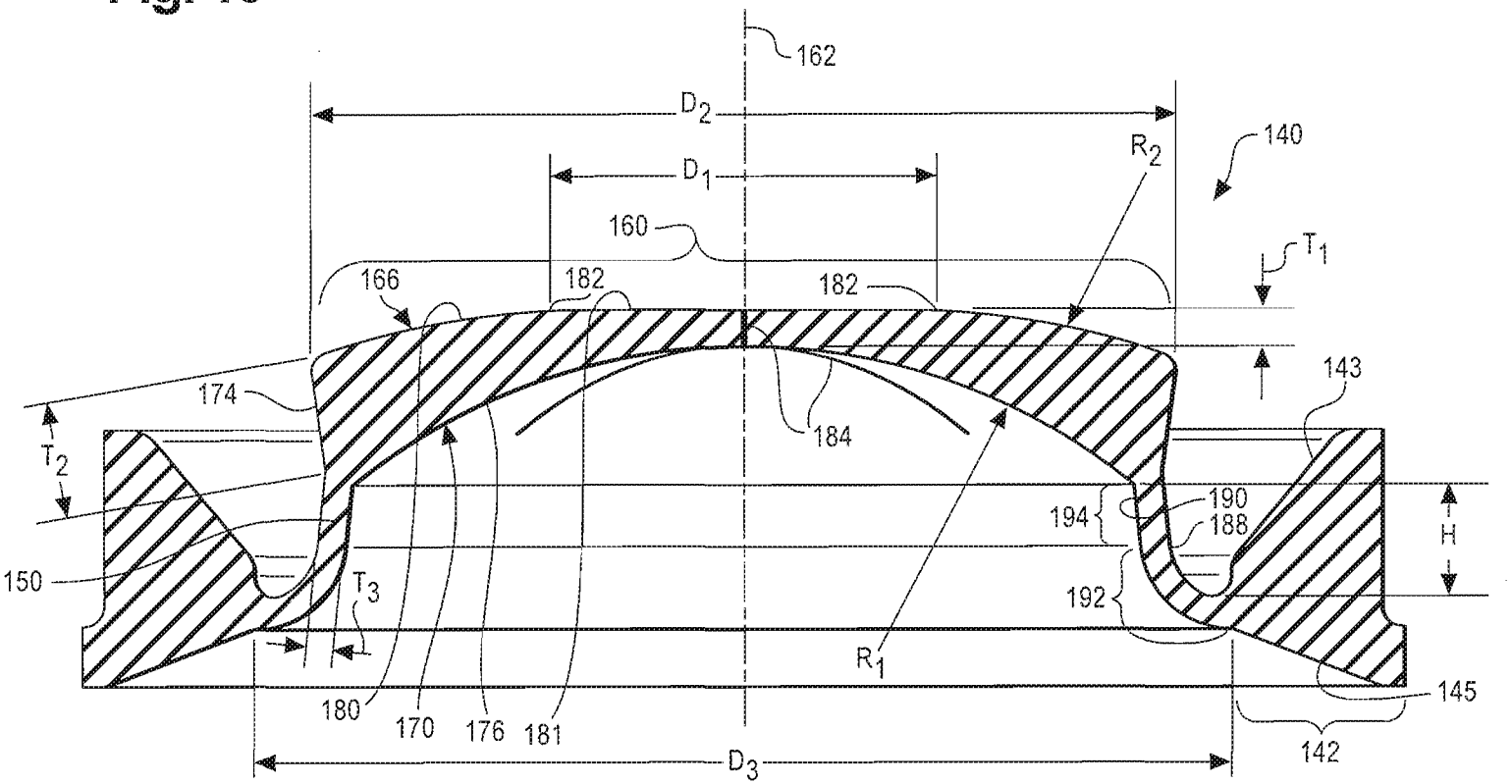
FIG. 10 is a cross-sectional view taken generally along the plane 10-10 in FIG. 9.
Figure 11:
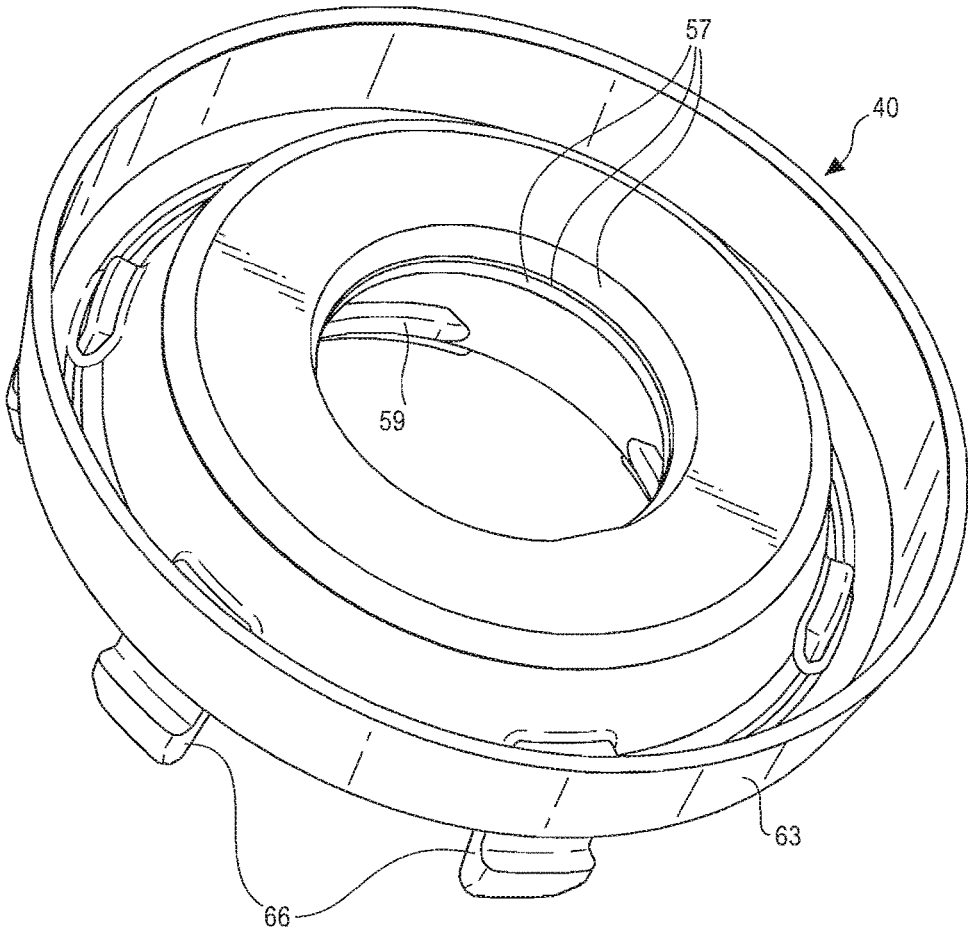
FIG. 11 is an isometric view of the outer collar of the device shown in FIGS. 1-7, and in FIG. 11 the outer collar is viewed looking toward the exterior, or downstream, side of the outer collar.

With reference to FIG. 10, the valve 140 has a peripheral mounting portion or flange 142. The flange 142 may have any suitable configuration for being mounted to, attached to, connected with, or for otherwise accommodating, the retainer ring 30 and annular frame 40 in which the valve 140 is installed. The particular configuration of the flange 142 illustrated in FIG. 10 may be characterized generally as a modified dove-tail configuration when viewed in vertical cross section.

As seen in FIGS. 5 and 6, the flange 142 is adapted to be clamped between the retainer ring 30 and annular frame 40 so as to hold the valve 140 in, and as part of the device 20. Preferably, the mounting flange 142 is somewhat resiliently compressed so as to accommodate the creation of a secure, leak-resistant seal when the valve flange 142 is compressively engaged between the retainer ring 30 and the annular frame 40. To that end, as seen in FIGS. 6 and 10, the valve flange 142 includes a frustoconical surface 143 for engaging the mating frustoconical surface 78 on the retainer ring 30, and the valve flange 142 also includes a frustoconical surface 145 for engaging the mating frustoconical surface 53 on the annular frame 40.

With appropriate modification of the retainer ring surface 78 and the annular frame surface 53, other shapes could be used for the valve flange 142. Some other shapes of flange cross sections which could be employed on the valve 140 are illustrated in the U.S. Pat. No. 5,409,144. In some applications, it may be desirable to configure the flange 142 for attachment to the ring 30 and/or frame 40 by means of adhesive, heat bonding, or other suitable means.

Extending generally radially inwardly from the flange 142 is a generally annular, intermediate portion or sleeve 150 (FIG. 10) which connects the flange 142 to a valve head 160 (FIG. 10). The valve head 160 is flexible and resilient. As can be seen in FIG. 10, valve head 160 has a generally circular configuration relative to a longitudinal axis 162 which can be characterized as being an extension of, and/or co-linear with, the longitudinal axis 162 defined by the retainer ring orifice 84 (see FIGS. 6 and 16). The fluid substance can be dispensed discharged) through the valve 140 in a discharge flow direction along the longitudinal axis 162 when the valve 140 opens as shown in FIG. 17.

Figure 17:
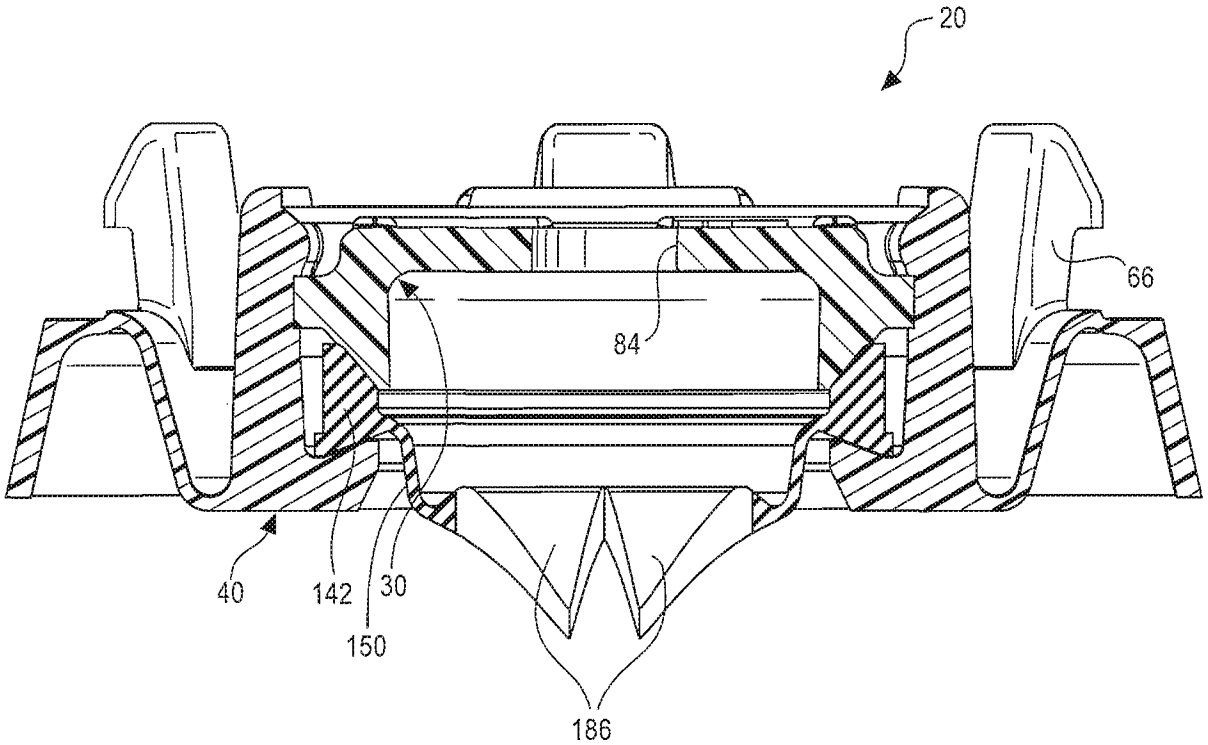
FIG. 17 is a cross-sectional view similar to FIG. 6, but FIG. 17 shows the valve in the opened condition in the flow control device as the valve would be opened under pressure from a discharging pressurized fluid substance flowing through the flow control device from the fluid substance supply system (not illustrated in FIG. 17).

The valve 140 is flexible and changes configuration between (1) a retracted, closed, rest position (as shown closed in FIG. 6), and (2) an extended, active, open position (as shown in FIG. 17). When the valve 140 is closed, the head 160 has a concave configuration (when viewed from the exterior of the device 20 as shown in FIGS. 6 and 7).

In the preferred embodiment illustrated, the flange 142, sleeve 150, and head 160 are oriented in a generally circular configuration and concentric relationship relative to a longitudinal axis 162 (FIG. 10) along which the fluid substance can be dispensed from the valve 140 in a discharge flow direction. The valve 140 (FIG. 10) may be characterized as having an axially outward direction that is defined by the discharge flow direction. The valve 140 may be further characterized as having a downstream side facing in the discharge flow direction (e.g., away from the orifice 84 in FIG. 7). The valve 140 may also be characterized as having an axially inward direction that is defined as a direction opposite to the axially outward direction. The valve 140 may be further characterized as having an upstream side facing in the axially inward direction (e.g., toward the orifice 84 in FIG. 7).

With reference to FIG. 10, the valve head 160 may be characterized as having an interior side 166 facing in the axially inward direction. With reference to FIG. 10, the valve head 160 may be further characterized as having an exterior side 170 facing in the axially outward direction.

With reference to FIG. 10, the outer perimeter of the valve head 160 is preferably defined by a slightly tapered, peripheral, marginal surface 174 which begins at an axially inwardly peripheral corner of the valve head 160 and extends axially outwardly therefrom with a slightly radially inward taper to ultimately terminate at the connector sleeve 150.

The valve head exterior side 170 has an exterior surface 176 (FIG. 10) which interfaces with the environment on the valve exterior side 170 and which has a recessed configuration as viewed looking toward the exterior surface 176 when the valve head 160 is in the fully retracted, closed position.

The valve head interior side 166 has an interior surface defined by a radially outward annular portion 180 (FIG. 10) that is partially spherical (and convex as viewed looking toward the valve interior side 166), and that is located radially outwardly from a central portion 181 of the valve head 160 when the valve head 160 is in the fully retracted, closed configuration. The central portion 181 has a planar, circular configuration when the valve head 160 is in the fully retracted, closed, position. With reference to FIG. 10, the annular portion 180 of the surface of the valve head interior side 166 lies on a partially spherical locus that defines a circular arc in longitudinal cross section as viewed along a plane containing the longitudinal axis 162. In the embodiment of the valve 140 illustrated in FIGS. 9 and 10, the boundary between the annular portion 180 and circular inner central portion 181 is defined by a circular tangent line 182 on the interior surface of the interior side 166 of the valve head 160.

With reference to FIG. 10, the valve head exterior surface 176 lies on a partially spherical locus that defines a circular arc in longitudinal cross section as viewed along a plane containing a longitudinal axis 162.

Further, in a preferred form of the embodiment of the valve 140 illustrated in FIG. 10, the radius of the circular arc of the valve head exterior surface 176 is smaller (less) than the radius of the circular arc of the annular portion 180 of the valve head interior side surface.

When the valve head 160 is viewed in cross section as illustrated in FIG. 10, the valve head 160 is somewhat thicker at a radially outside portion of the valve head 160, and is thinner at a radially inside portion of the valve head 160. This configuration assists in providing a desirable opening action and closing action.

Figure 8:
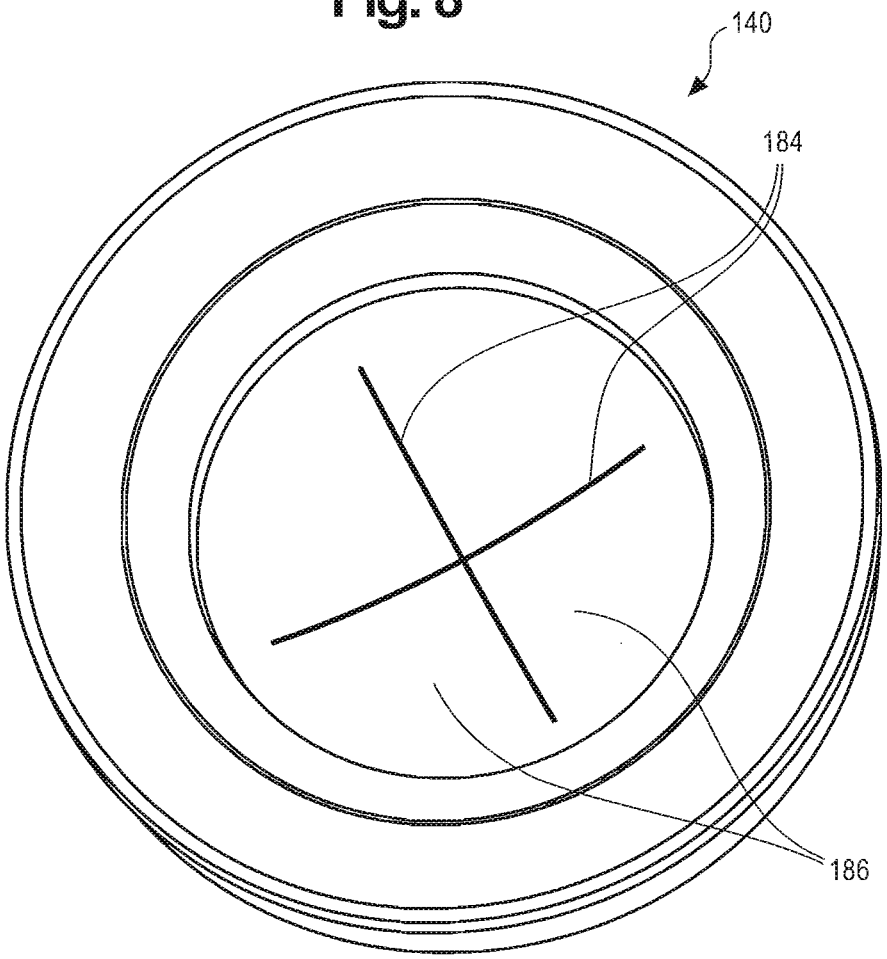
FIG. 8 is an isometric view of the valve employed in the device illustrated in FIGS. 1-7, and in FIG. 8 the valve is viewed looking toward the interior, or upstream, side of the valve.
Figure 9:
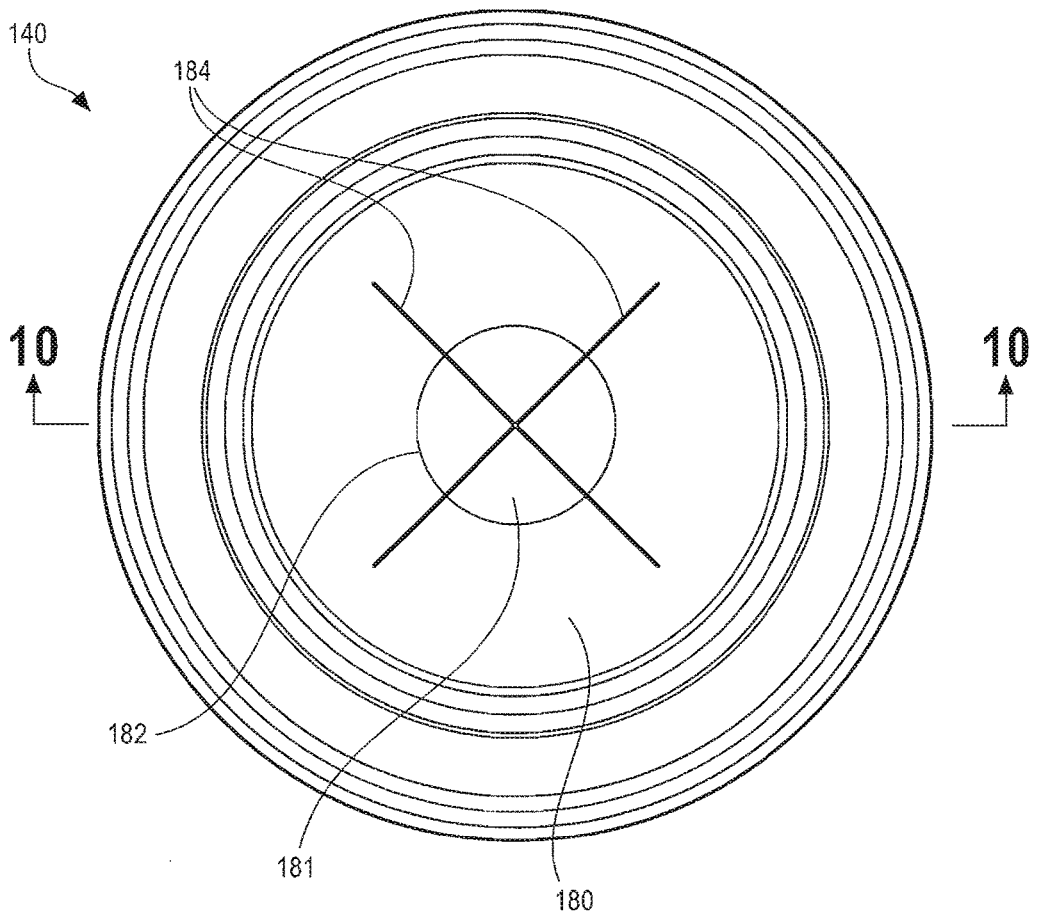
FIG. 9 is a plan view of the interior, or upstream, side of the valve shown in FIG. 8.

With reference to FIGS. 8, 9, and 10, the valve head 160 has a normally closed orifice defined by a plurality of slits 184 radiating laterally or radially from the valve head longitudinal axis 162 (illustrated in FIG. 10). The illustrated embodiment of the valve 140 has four slits 184. A lesser or greater number of slits 184 could be used. The slits 184 extend transversely through the valve head 160 from the interior side 166 to the exterior side 176. Each slit 184 terminates in a radially outer end. In the illustrated embodiment of the valve 140, the slits 184 are of equal length, although the slits could be of unequal lengths.

In the preferred form embodiment of the valve 140, each slit 184 is planar and parallel to the central longitudinal axis 162 of the valve. Each slit 184 preferably defines a linear locus along the head exterior side surface 176 and along the surface of the head interior side 166. Preferably, the slits 184 diverge from an origin on the longitudinal axis 162 and define equal size angles between each pair of adjacent slits 184. Preferably, four slits 184 diverge at 90 degree angles to define two mutually perpendicular, intersecting, longer slits. In the preferred form of the valve 140, the four slits 184 may be alternatively characterized as being two longer intersecting slits oriented at equal angles of intersection. The length and location of the slits 184 can be adjusted to vary the predetermined opening pressure of the valve 140, as well as other dispensing characteristics.

The slits 184 define four, generally sector-shaped, equally sized flaps or petals 186 (FIGS. 8 and 17) in the valve head 160. The flaps or petals 186 may be also characterized as "openable regions" or "openable portions" of the valve head 160. Each flap or petal 186 has a pair of diverging transverse faces defined by the slits 184, and each transverse face seals against a confronting transverse face of an adjacent petal 186 when the valve 140 is closed.

The valve 140 can be molded with the slits 184. Alternatively, the valve slits 184 can be subsequently cut into the central head 160 of the valve 140 by suitable conventional techniques. In operation, the petals 186 can be forced open outwardly (downwardly in FIG. 17) from the intersection point of the slits 184 when a sufficient force is applied to the interior side 166 of the valve head 160 (as by subjecting the valve head 160 to a pressure differential across the valve head 160).

When the valve 140 is in the fully retracted, closed position (FIG. 10), the connector sleeve 150 has a tubular configuration in the form of a tubular membrane 150, and the membrane 150 defines an interior surface 188 and an exterior surface 190. When viewed in longitudinal cross section (as seen in FIG. 10), the connector sleeve 150 has an arcuate, first leg portion 192 that is connected with the valve flange 142, and has a generally straight, second leg portion 194 that extends from the first leg portion 192 to connect with the valve head 160. The thickness of each leg portion 192 and 194 is about the same in the illustrated embodiment, but the thicknesses may vary.

In the illustrated embodiment of the valve 140, the connector sleeve 150 locates the valve head 160 so that a portion of the valve head 160 projects axially outwardly beyond the marginal flange 142 (FIG. 10).

The sleeve 150 of the valve 140 is preferably configured for use in conjunction with a particular system, and a specific type of fluid substance, so as to achieve the flow characteristics desired. For example, the viscosity and density of the fluent substance are factors to be considered. The rigidity and durometer of the valve material, and size and thickness of portions of both the valve head 160 and the connector sleeve 150, are additional factors to be considered.

The valve 140 opens outwardly when the valve 140 is subjected to a sufficient pressure differential (i.e., a lower pressure on the exterior side of the valve head 160 than on the interior side of the valve head 160). In some applications (not described herein), the valve 140 could be utilized to accommodate in-venting by opening inwardly (when the lower pressure is on the interior side of the valve 140).

The preferred embodiment of the illustrated flow control device 20 is intended in many applications to be opened by a pressure on the interior that is greater than the ambient pressure at the device outlet. However, the valve 140 could be opened outwardly by subjecting the valve exterior side to a reduced pressure (i.e., greater than the ambient exterior (i.e., external) pressure). Nevertheless, in many contemplated typical dispensing applications, the valve 140 is opened by subjecting the interior side of the valve head 160 to an increased pressure. In the following discussion, the operation of the valve 140 will be described with reference to such an increased interior pressure which is sufficient to open the valve 140 outwardly into a lower ambient pressure environment.

The opening of the valve 140 may be characterized as occurring in response to a predetermined minimum opening pressure. The valve 140 is typically designed to have a predetermined minimum opening pressure which causes the valve petals 186 to open to a desired cross-sectional flow area which may be characterized as fully open for the particular design pressure differential across the valve. The selection of a desired predetermined minimum opening pressure is determined in accordance with, inter alia, the flow criteria desired for a particular fluid substance, and/or the maximum static head (if any), or other upstream pressure, that is exerted on the interior side of the valve 140 below which the valve 140 is designed to remain closed.

In operation, the valve 140 functions in the following manner. The valve 140 normally assumes an initial, normally closed configuration illustrated in FIGS. 5, 6, 7, and 10, wherein the valve 140 remains substantially in its original, as-molded shape without deformation (except perhaps at the flange 142 if the flange 142 is sufficiently compressively engaged by the mounting components). When the valve 140 is in the normally closed configuration, the connector sleeve 150 is substantially unstressed, the valve discharge orifice slits 184 are completely closed, and the valve head 160 is in a retracted position that is somewhat axially inwardly relative to the position that the valve head 160 will have when it is opened.

When a sufficient pressure differential is established across the valve head 160—such as when increased pressure is established on the valve interior side 166—the leg portions 192 and/or 194 of the connector sleeve 150 begin to distort, and the valve head 160 begins to shift somewhat axially outwardly (downwardly in FIGS. 5, 6, and 7 toward the full open position shown in FIG. 17).

As the interior 166 side of the valve head 160 is subjected to additional pressure, the valve head 160 continues to move slightly outwardly as the sleeve 150 is distorted outwardly (downwardly as viewed in FIG. 10).

When the interior side of the valve head 160 is subjected to further increased pressure, the valve head 160, per se, continues to shift slightly outwardly. However, because connector sleeve 150 is already extended outwardly, further outward shifting of the valve head 160 slightly stretches and tensions the connector sleeve 150, thereby increasing the outwardly directed torque applied to the valve head 160. Also, the further outward movement of the valve head 160 tends to flatten or straighten the valve head 160, particularly along the exterior surface 176 thereof. This flattening motion tends to slightly enlarge or dilate the circular plan configuration of the valve head 160, which enlargement is in turn resisted by radially inwardly directed forces applied to the marginal surface 174 of the valve head 160 by the connector sleeve 150, thereby generating another complex pattern of stresses within the valve 140, and these include stresses which tend to compress the valve head 160 in a radially inward direction.

When additional pressure is applied to the interior side of the valve head 160, the valve head 160 continues to shift outwardly by further longitudinal stretching of the connector sleeve 150 in the outward direction, and further enlargement of the plan shape of the valve head 160. The marginal portion 174 of the valve head 160 is elastically deformed farther inwardly, as a consequence of the increased torque forces applied thereto by the connector sleeve 150. These combined forces and motions also serve to further compress the valve head 160, which occurs just prior to the valve petals 186 starting to open, wherein the valve head 160 is in a temporary, relatively unstable condition of equilibrium that can be characterized as a "bifurcation state". The combined forces acting on the valve head 160 in the bifurcation state will, upon application of any additional outward force on the surface of the valve head interior side 166, cause the valve 140 to quickly open outwardly by separating the valve petals 186 to create an open orifice in the manner illustrated in FIG. 17, and thereby dispense the fluid substance through the valve head open petals 186.

It will be appreciated that while various theories and explanations have been set forth herein with respect to how forces and stresses may affect the operation of the valve 140, there is no intention to be bound by such theories and explanations. Further it is intended that all structures falling within the scope of the appended claims are not to be otherwise excluded from the scope of the claims merely because the operation of such valve structures may not be accounted for by the explanations and theories presented herein.

With reference to FIG. 7, the novel arrangement of the retainer ring 30 and annular frame 40 defines a "housing" 30/40 that locates the valve 140 across the outlet discharge end 57 at a location spaced from the housing orifice 84 so that (a) the longitudinal axis 162 of the valve head 160 is co-linear with the longitudinal axis 162 defined by the orifice 84, and (b) the valve 140 and the housing 30/40 together define an expansion chamber 198 (FIG. 7) between the orifice 84 and the valve 140 for receiving the fluid substance at a pressure reduced from the pressure within the supply system 22. The above-described novel arrangement results in the pressure from the supply system 22 being reduced to a lower pressure, but the pressure is still sufficiently high to open the valve 140 to the designed open configuration (FIG. 17). The relatively long slits 184 of the valve 140 enable the valve petals 186 to open relatively wide to provide a desirably large cross-sectional flow area.

The fluid substance can be discharged through the flow control device 20 at a relatively low pressure and a relatively low flow speed (velocity) but with enough volumetric flow to provide the desired amount of discharged product. The low pressure and low flow speed can eliminate, or at least minimize or reduce, lateral spray.

Further, the lower pressure and lower flow speed can eliminate, or at least reduce, other undesirable flow characteristics (e.g., flow stream non-uniformity, inconsistent substance properties across the flow stream, undesirable flow stream cross-sectional configuration, etc.)

Also, the use of the flow control device 20 can eliminate, or at least reduce, the tendency of a small drop or droplets of a discharging fluid substance to remain on the device or system after the flow discharge has been terminated. That is a result of the relatively quick and positive sealing action of the valve petals 186 after completion of the substance discharge (as would occur upon all of the substance being dispensed from the supply system 22, or after the pressure in the supply system 22 has been reduced to a lower pressure at which the pressure differential across the open valve petals 186 would permit the open valve petals 186 to return to the closed configuration) owing to the resiliency of the valve 140.

According to one presently preferred embodiment design for a particular application, and with reference to FIG. 10, the valve 140 has a durometer of 40 and is molded from a liquid silicone rubber sold under U.S. trademark XIAMETER and product design grade RBL-9595-40 LSR in the United States of America by the Dow Corning Corporation having a corporate center office mail address of PO Box 994, Midland, Mich. 48686 U.S.A. The valve 140 has the following specific design features:

1. The valve head exterior surface 176 lies on a partially spherical locus that defines a circular arc in longitudinal cross section as viewed along a plane containing the longitudinal axis 162. The radius of the circular arc spherical exterior surface 176 is designated in FIG. 10 by the reference character $R_1$ and is 3.962 mm.
2. As illustrated in FIG. 10, the radially outer annular portion 180 of the surface of the valve head interior side 166 is partially spherical, and as can be seen in FIG. 10, has a circular arc radius $R_2$ (as viewed in longitudinal cross section along a plane containing longitudinal axis 162) equal to 5.384 mm.

3. The inner circular central portion 181 of the surface of the valve head interior side 166 has a diameter $D_1$ of 2.01 mm.
4. The outermost diameter $D_2$ of the valve head 160 is 5.48 mm.
5. The thickness $T_1$ of the valve head 160 at the center of the intersecting slits 184, is less than the valve head thickness $T_2$ at the valve head along the peripheral surface 174, and $T_1$ is 0.96 mm and $T_2$ is 0.58 mm.
6. The height H of the connector sleeve 150 is 0.71 mm.
7. The diameter $D_3$ of the widest part of the sleeve 150, where it connects with flange 142, is 6.26 mm.
8. The thickness $T_3$ of the sleeve 150 is 0.17 mm.
9. Each slit 184 has the same length as measured from the central longitudinal axis 162 to the radial outmost end of the slit 184 in plan view (i.e., not the actual arc length). For one type of substance dispensed at desired conditions, a presently preferred range of the length of each slit 184 is between about 1.78 mm and about 2.03 mm.
10. The minimum pressure differential across the valve 140 that causes the valve 140 to open to its design opening cross-sectional flow area is in the range of about 10.5 kPa to about 12.3 kPa.

According to one presently preferred embodiment design of the retainer ring 30 and annular frame 40 for a particular application using the above-described preferred form of the valve 140 having a valve head slit length of about 1.78 mm, the following dimensions are preferred:

1. the diameter of the retainer ring orifice 84 (FIG. 16) is 2.1 mm;
2. the axial length of the orifice 84 through retainer ring plate 74 is 0.63 mm; and
3. when the valve 140 is in the closed configuration as shown in FIG. 7, the axial perpendicular distance between (1) a first plane defining the exit side of the orifice 84 along the bottom of the plate portion 74, and (2) a parallel, second plane defining the surface of the valve head circular, planar, central portion 181 is in the range of 0.34-0.44 mm. With this arrangement, the following relationships are defined:
   a) the diameter of the orifice 84 is about 40% of the diameter of the valve head (160) when the valve 140 is closed,
   b) the diameter of the orifice 84 is about 3.3 times the length of the orifice 84,
   c) the ratio of the diameter of the orifice 84 to the shortest distance between the orifice 84 and the valve head 160 is between about 4.8 and 6.2 when the valve 140 is closed; and
   d) the volume of the expansion chamber 198 is about 0.022781 mL.

The following characteristics are observed when dispensing a particular fluid substance (having a temperature between about 4.4° C. and about 15° C.) from a flow control device 20 comprising the embodiments of the valve 140, ring 30, and frame 40 having the preferred dimensions and features as described above (except the length of each valve head slit 184 is 1.9 mm (as measured from the central longitudinal axis 162 to the radial outermost end of the slit in plan view)), and wherein the pressure of the fluid substance in the supply system 22 at the upstream side of the orifice 84 is about 24.1 kPa, and the fluid substance is discharged from the valve 140 into an external ambient atmosphere having a pressure in the range of about 3.7 kPa to about 4.3 kPa (28-32 inches of mercury) and a temperature in the range of 20° C. to 24° C.:

1) the expansion chamber internal pressure is about 16.96 kPa;
2) the fluid flow rate through the valve 140 is about 10.25 mL/s; and
3) the exit speed is about 3.42 m/s through the valve 140.

The present invention can be summarized in the following statements or aspects numbered 1-16.

1. A flow control device for controlling the flow of a pressurized fluid substance from a supply system that has an opening between the exterior and interior of the supply system, said flow control device comprising:
   A. a housing that
      1) has an inlet end that can be located at the supply system opening;
      2) includes an orifice that is centered on a central longitudinal axis and that can communicate between the exterior and interior of the supply system; and
      3) has an outlet end defining a discharge opening; and
   B. a valve having a flexible, resilient, circular valve head centered on said longitudinal axis and that has
      1) at least one self-sealing slit through said valve head; and
      2) confronting, openable portions along said at least one self-sealing slit in an initially closed configuration, said openable portions being movable from said closed configuration to an open configuration when said valve head is subjected to a pressure differential acting across said valve head; and wherein said valve is located across said housing outlet end discharge opening at a location spaced from said housing orifice so that (a) said longitudinal axis of said valve head is co-linear with said longitudinal axis defined by said orifice, and (b) said valve and said housing together define an expansion chamber between said orifice and said valve for receiving the fluid substance at a pressure reduced from the pressure within the supply system.
2. The flow control device in accordance with aspect 1 in which said housing is either
   A. a separate structure for being attached to a supply system at the supply system opening, or
   B. an integral structure that is a unitary part of the supply system at the supply system opening.
3. The flow control device in accordance with the preceding aspects 1 or 2 for use with a supply system that is defined by a container having an opening that defines the supply system opening, and wherein said flow control device is initially separate from, but can be subsequently attached to, the container at the container opening,
4. The flow control device in accordance with any of the preceding aspects 1-3 in which said housing is a two-piece housing comprising:
   (1) an annular frame for
      (a) being attached to the supply system at the supply system opening; and
      (b) receiving said valve supported thereon; and
   (2) an annular retainer ring that
      (a) is received in said annular frame;
      (b) defines said orifice; and
      (c) retains said valve in said annular frame so that said expansion chamber is defined between said annular retainer ring and said valve.
5. The flow control device in accordance with aspect 4 in which said annular frame includes 1. a first annular wall;
2. a frustoconical seating surface extending radially inwardly from said first annular wall for engaging a portion of said valve; and
3. a plurality of circumferentially spaced-apart beads that extend radially inwardly from said first annular wall and that are spaced axially inwardly of said seating surface for engaging said retainer ring to hold said retainer ring in snap-fit engagement against a portion of said valve to clamp said valve between said retainer ring and said annular frame.

6. The flow control device in accordance with aspect 5 in which said annular frame includes
1. a second annular wall around said first annular wall; and
2. a plurality of circumferentially spaced tabs extending from said second annular wall, each said tab including a radially outwardly facing recess for receiving a portion of the supply system in snap-fit engagement to mount said flow control device to the supply system.

7. The flow control device in accordance with aspect 6 in which each said tab has a chamfered distal end to accommodate initial sliding engagement with, and movement relative to, the supply system to effect snap-fit engagement of said flow control device with the supply system.

8. The flow control device in accordance with aspect 4 in which said retainer ring includes a frustoconical clamping surface for engaging a portion of said valve to clamp said valve between said retainer ring and said annular frame.

9. The flow control device in accordance with any of the preceding aspects 1-4, in which said valve includes a peripheral attachment portion engaged with said housing;
said valve includes an annular, flexible, resilient intermediate portion connecting said peripheral attachment portion with said valve head; and
said valve head has a pair of intersecting, self-sealing slits, and four confronting, openable portions.

10. The flow control device in accordance with any of the preceding aspects 1-9 in which said orifice has a diameter which is about 3.3 times the length of said orifice.

11. The flow control device in accordance with any of the preceding aspects 1-10 in which said orifice has a diameter which is about 40% of the diameter of said valve head when said valve is closed.

12. The flow control device in accordance with any of the preceding aspects 1-11 in which the ratio of the diameter of said orifice to the shortest distance between said orifice and said valve head is between about 4.8 and about 6.2 when said valve is closed.

13. The flow control device in accordance with any of the preceding aspects 1-12 in which
said valve head is generally circular with respect to a longitudinal axis and has slits intersecting at said longitudinal axis; and
said orifice has a cylindrical configuration centered on said longitudinal axis.

14. A flow control device for controlling the flow of a pressurized fluid substance from a supply system that has an opening between the exterior and interior of the supply system, said flow controller comprising:
A. a housing that
(1) has an inlet end that can be located at the supply system opening;
(2) defines an orifice for communicating between the supply system exterior and interior; and
(3) has an outlet end defining a discharge opening; and
B. a valve having a flexible, resilient valve head that has
1) at least one self-sealing slit through said valve head; and
2) confronting, openable portions along said at least one self-sealing slit in an initially closed configuration, said openable portions being movable from said closed configuration to an open configuration when said valve head is subjected to a pressure differential acting across said valve head;
wherein said valve is located across said housing outlet end discharge opening at a location spaced from said housing orifice so that said valve and said housing together define an expansion chamber between said orifice and said valve for receiving the fluid substance at a pressure reduced from the pressure within the supply system;
wherein said housing comprises
1) an annular frame for
a) being attached to the supply system at the supply system opening; and
b) receiving said valve supported thereon; and
2) an annular retainer ring that
a) is received in said annular frame;
b) defines said orifice; and
c) retains said valve in said annular frame so that said expansion chamber is defined between said annular retainer ring and said valve; and
wherein said annular frame includes
1) a first annular wall for engaging said retainer ring to hold said retainer ring against said valve;
2) a seating surface extending radially inwardly from said first annular wall for engaging a portion of said valve;
3) a second annular wall around said first annular wall; and
4) a plurality of circumferentially spaced tabs extending from said second annular wall, each said tab including a radially outwardly facing recess for receiving a portion of the supply system in snap-fit engagement to mount said flow control device to the supply system.

15. The flow control device in accordance with aspect 14 in which each said tab has a chamfered distal end to accommodate initial sliding engagement with, and movement relative to, the supply system to effect snap-fit engagement of said flow control device with the supply system.

16. A process for controlling the flow of a pressurized fluid substance from a supply system that has an opening between the exterior and interior of the supply system, said process comprising the steps of:
A. providing a housing that
1) has an inlet end that can be located at the supply system opening;
2) defines an orifice for communicating between the exterior and interior of the supply system; and
3) has an outlet end defining a discharge opening; and
B. providing a valve having an upstream, interior side for facing said orifice and having a flexible, resilient valve head that has
1) at least one self-sealing slit through said valve head; and 2) confronting, openable portions along said at least one self-sealing slit in an initially closed configuration, said openable portions being movable from said closed configuration to an open configuration when said valve head is subjected to a pressure differential acting across said valve head;

C. locating said valve across said housing outlet end discharge opening at a location spaced from said housing orifice so that said valve and said housing together define an expansion chamber between said orifice and said valve for receiving the fluid substance at a pressure reduced from the pressure within the supply system;

D. supplying the fluid substance in the supply system at a gauge pressurebetween about 24 kPa and about 25 kPa;

E. admitting the fluid substance through said orifice into said expansion chamber at a gauge pressure between about 16 kPa and about 21 kPa on said upstream side of said valve; and F. discharging the fluid substance through said valve in the open configuration.

Various modifications and alterations to this invention will become apparent to those skilled in the art without departing from the scope and spirit of this invention. Illustrative embodiments and examples are provided as examples only and are not intended to limit the scope of the present invention.

What is claimed is:

1. A process for controlling the flow of a pressurized fluid substance from a supply system (22) that has an opening (24) between the exterior and interior of the supply system (22), said process comprising the steps of:

A. providing a housing (30/40) that (1) has an inlet end that can be located at the supply system opening (24);

(2) defines an orifice (84) for communicating between the exterior and interior of the supply system (22); and (3) has an outlet end defining a discharge opening (57); and B. providing a valve (140) having an upstream, interior side (166) for facing said orifice (84) and having a flexible, resilient valve head (160) that has 1) at least one self-sealing slit (184) through said valve head (160); and 2) confronting, openable portions (186) along said at least one self-sealing slit (184) in an initially closed configuration, said openable portions (1.86) being movable from said closed configuration to an open configuration when said valve head (160) is subjected to a pressure differential acting across said valve head (160);

C. locating said valve (140) across said housing outlet end discharge opening (57) at a location spaced from said housing orifice (84) so that said valve (140) and said housing (30/40) together define an expansion chamber (198) between said orifice (84) and said valve (140) for receiving the fluid substance at a pressure reduced from the pressure within the supply system (22);

D. supplying the fluid substance in the supply system (22) at a gauge pressure between about 24 kPa and about 25 kPa;

E. admitting the fluid substance through said orifice (84) into said expansion chamber (198) at a gauge pressure between about 16 kPa and about 21 kPa on said upstream side (166) of said valve (140); and F. discharging the fluid substance through said valve (140) in said open configuration.

* * * * *